US005354030A

United States Patent [19]

Harwood

[11] Patent Number: 5,354,030

[45] Date of Patent: Oct. 11, 1994

[54] RETAINER RING

[76] Inventor: Ronald P. Harwood, 31110 Applwood, Farmington Hills, Mich. 48331

[21] Appl. No.: 105,610

[22] Filed: Aug. 12, 1993

Related U.S. Application Data

[62] Division of Ser. No. 905,786, Jun. 29, 1992.

[51] Int. Cl.[5] ..... A47G 1/10

[52] U.S. Cl. ..... 248/316.1; 248/231.5; 248/231.8; 362/396

[58] Field of Search ..... 248/309.1, 314, 315, 248/316.1, 316.5, 316.7, 231.5, 231.8, 74.1, 74.2; 362/396

[56] References Cited

U.S. PATENT DOCUMENTS

| | | | |
|---|---|---|---|
| 288,058 | 11/1883 | Hollister | 248/315 |
| 1,747,279 | 2/1930 | Andreino | 362/419 X |
| 4,112,486 | 9/1978 | Tovi | 362/419 |
| 4,814,955 | 3/1989 | Price | 362/275 |
| 5,140,507 | 8/1992 | Harwood | 362/271 |

FOREIGN PATENT DOCUMENTS

| | | | |
|---|---|---|---|
| 0011566 | of 1906 | United Kingdom | 362/396 |

*Primary Examiner*—Ramon O. Ramirez
*Attorney, Agent, or Firm*—Marshall & Melhorn

[57] ABSTRACT

A power transfer means is connected to a fixture mounting pendant or pole. At least one note of power input to the power transfer means is provided. Mounted to the power transfer means is a fixture or adjustable mounting bar construction. A retaining ring is adjustably movable along the mounting bar or beam member. One or more of said retaining rings mounted the mounting bar are able to retain accessories for the lighting system.

A low voltage transfer means is provided which is easily mountable to the beam member when it is necessary to convert the lighting system to a low voltage application.

11 Claims, 3 Drawing Sheets

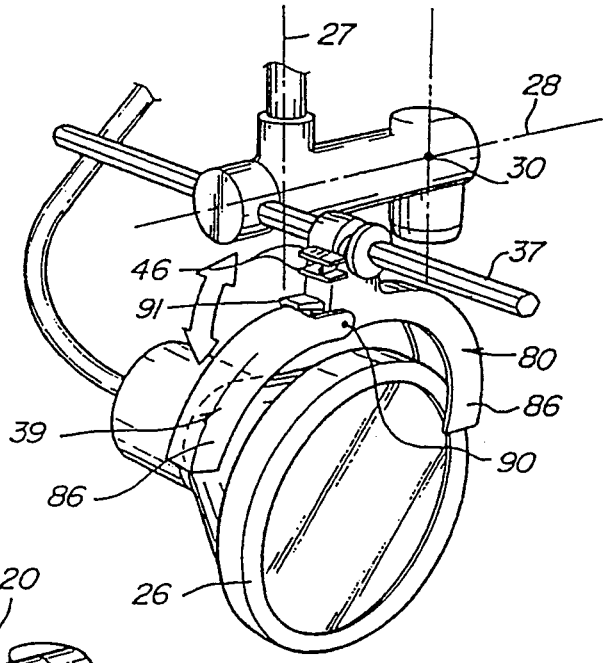
Fig-5
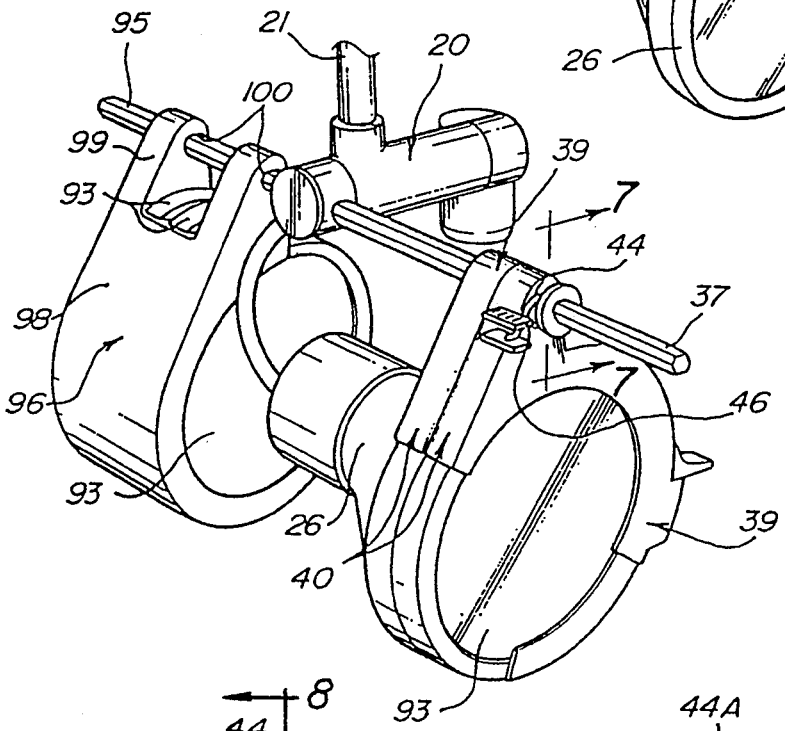
Fig-6
Fig-8
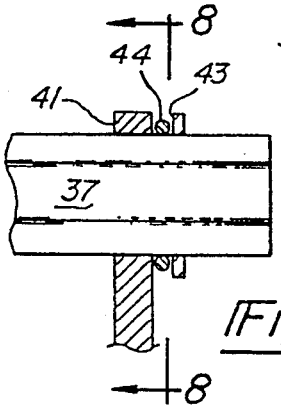
Fig-7
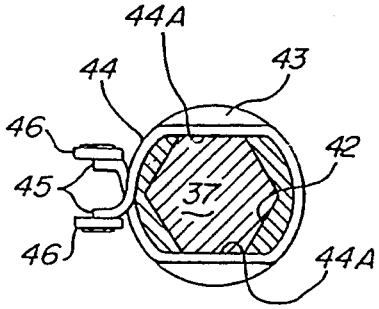

RETAINER RING

CROSS REFERENCE TO RELATED APPLICATION

The present Application is a division of co-pending application Ser. No. 07/905,786, filed Jun. 29, 1992, in the name of Ronald P. Harwood, for an INTEGRATED LIGHTING SYSTEM.

BACKGROUND OF THE INVENTION

1. Field of the Invention

The present invention relates to lighting systems. More particularly, the invention relates to spot light type lighting systems of the type which illuminate stage plays, live performances, retail display areas and the like.

2. Description of the Prior Art

The problem of how to provide a useful lighting system which is versatile enough to perform all the functions needed of a spot light, and yet not be unduly cumbersome or inconvenient to use, is one of longstanding in the prior art. Such a lighting system has many requirements depending on the use to which it is put. If, for example, such a lighting system is being used in an outdoor amphitheater, the requirement of most importance would be the ability to deliver a large amount of light in various colors, and to focus such light precisely. The size or ease of adjustability of such lights are usually not of concern.

If, however, such lights are used to illuminate indoor stages or retail display areas, the requirements become quite different. It may be required, for example, to use a low voltage bulb instead of one working off line voltage, and to adjust the light fixture, including the focusing features, from a remote location.

In addition, in either situation, many parts are needed, such as template projectors, bellows, barn doors, color filters and focusing lenses. It is a common complaint among lighting technicians that so many parts are required that they frequently get lost, and it is easier to replace them rather than find them. This leads to an unnecessary waste of scarce resources. Therefore, those skilled in the art have continued to search for an easily adjustable lighting system which can be changed between line voltage and low voltage, and which has a self storing feature.

SUMMARY OF THE INVENTION

In order to solve the problems longstanding in the spot light art, and provide a flexible convenient and easy to use lighting system, there is provided a power transfer means which is connected to a fixture mounting pendant or pole. At least one node of power input to the power transfer means is provided. Mounted to the power transfer means is a fixed or adjustable mounting bar construction. A unique retaining ring is adjustably moveable along the mounting bar or beam member. One or more of said retaining rings mounted to the mounting bar are able to retain all the needed parts of the lighting system.

A low voltage transformer means is provided which is easily mountable to a rearwardly projecting portion of the beam member when it is necessary to convert to a low voltage application.

In one modification of the present invention, a mounting bar or beam is mounted to a power transfer means provided at the lower end of a mounting pendant. The power transfer means has a single node of power input, which may be offset from the axis of the mounting pendant or pole or first axis of rotation. If the node is offset, orbiting it in a circle about the first axis of rotation rotates the mounting beam or bar about said first axis of rotation. A rotational power input to the node will rotate the bar about the other axis of rotation, which may be perpendicular to the first axis of rotation.

In another modification of the present invention, a novel retaining ring is provided which is slidably adjustable along the length of the mounting beam or bar mounted to the power transfer means. The mounting beam or bar may be of solid or hollow construction, with at least some portions of the lighting system being mounted to the bar. Many different parts of an integrated lighting system, such as a reducing ring, a template projector, a focusing lens, a color filter, barn doors and bellows can be held by the retaining rings.

In a third modification of the present invention, a voltage reduction transformer is provided which can be interposed between a socket cap and a low voltage lamp. It may be mounted to a mounting beam or bar mounted to the lower end of a mounting pendant to provide for an easy change from a high voltage application to a low voltage application.

In another modification of the invention, a split retaining ring is provided. The retaining ring has a fixed semi-circular housing in which is mounted an inner semi-circular ring section. A spring keeps the inner ring section in a normally closed position enclosing about three-quarters of a circle.

In another modification of the invention, a caliper type retaining ring is provided. It consists of one fixed arm with an upper end collar at one end which slides on the mounting bar or rod. A pair of arms which swing open to remove or install accessories, and which may be biased to a normally closed position with a spring loaded lock tab.

Thus it is an object of the present invention to provide an improved lighting system applicable to all ranges of spot lighting applications.

A further object of the present invention to provide a lighting system for use in illuminating areas where spot lights are needed which can easily be changed from a high voltage to a low voltage application.

A still further object of the present invention is to provide an integrated lighting system of the foregoing nature which is easily changeable from a high voltage application to a low voltage application by the provision of a voltage reduction transformer easily connectible to a standard socket cap.

A further object of the present invention is to provide for the various components required for the present lighting system to be mounted either on a mounting bar, or on a retaining ring which itself is mounted to a mounting bar. The mounting bar is able to rotate about a first and a second axis of rotation.

A still further object of the present invention is to provide an integrated lighting system of the foregoing nature which may be used in a track lighting system.

Another object of the invention is to provide an integrated lighting system which may easily be adjusted from a remote location without presenting any burn hazard to the adjusting personnel.

Another object of the present invention is to provide for an integrated lighting system which may be adjusted without the need for ladders and the like.

Further objects and advantages of the present invention will be apparent from the following description and appended claims, reference being made to the accompanying drawings forming a part of the specification, wherein like reference characters designate corresponding parts in the several views.

BRIEF DESCRIPTION OF THE DRAWINGS

FIG. 5 is a view, similar to FIG. 1, showing a the caliper-type retaining ring mounted to a power transfer means having an offset axis of power input.

FIG. 6 is a view similar in part to FIG. 1, and showing, in addition, a storage means or caddie mounted to a rearwardly extending portion of the mounting bar or rod for storing additional accessories, such as lenses.

FIG. 7 is a sectional view, taken in the direction of the arrows, along the section line 7—7 of FIG. 6.

FIG. 8 is a sectional view, taken in the direction of the arrows, along the section line 8—8 of FIG. 7.

It is to be understood that present invention is not limited to the details of construction and arrangement of parts illustrated in the accompanying drawings, since the invention is capable of other embodiments, and is capable of being practiced or carried out in various ways within the scope of the claims. Also, it is to be understood that the phraseology and terminology employed herein is for the purpose of description, and not of limitation.

DETAILED DESCRIPTION OF THE PREFERRED EMBODIMENTS

Figure 1:
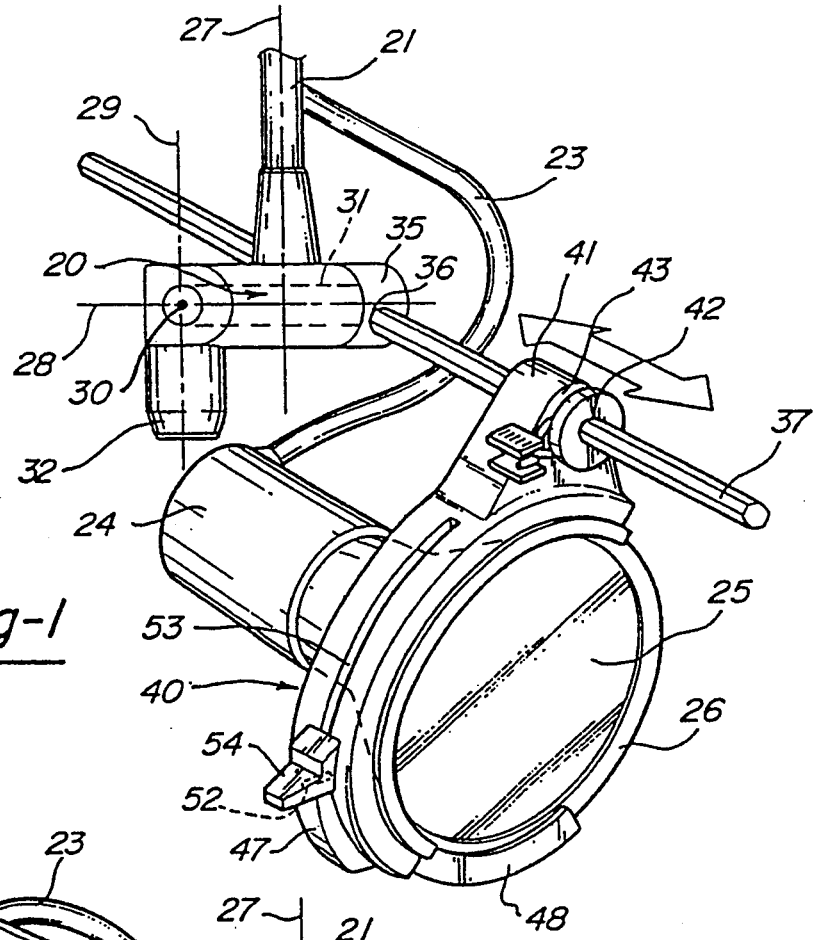
FIG. 1 is a perspective view of the lighting system of the present invention, wherein a mounting rod or bar is mounted to a power transfer means provided at the bottom of a mounting pole or pendant for rotation about two axes of rotation through an offset axis of power input. A novel retaining ring is slidably adjustable along the length of said mounting bar or rod, said retaining ring adapted to hold a spotlight connected by way of a socket to a source of line voltage.

Referring now to FIG. 1, there is shown a power transfer means 20 which may be fixedly or rotatably mounted to the lower end of a fixture mounting pole or pendant 21 in any of the ways well known in the art, such as those shown in my earlier co-pending application Ser. No. PCT/US92/01552, which is a continuation-in-part of U.S. patent application Ser. No. 07/662,430, now U.S. Pat. No. 5,140,507. The fixture mounting pole or pendant 21 may be mounted to a conventional track head (not shown). Power is supplied through the power cord 23, through the socket 24, to the lamp 25 which is mounted in the luminaire, lamp holder, or lamp ring 26. It can be seen that fixture mounting pole 21 is coaxial with a first axis of rotation 27. Said first axis of rotation intersects a second axis of rotation 28.

It can be seen that the single node of power input in this embodiment of the invention is at the point indicated at 30, which is offset from the first axis of rotation 27. A shaft 30 is journalled for rotation in the power transfer means 20. Rotation of the knob 32 about said offset axis of power input 29 causes rotation, by means well known in the art, of the shaft 30. The shaft 30 is connected to adapter 35, which is provided with a beam mounting hole 36 in which is a mounting bar or beam 37. It should be understood that mounting bar 37 could be fixedly mounted in the hole by means such as a set screw (not shown) or could be permanently affixed to the adapter 35. Also, the mounting bar 37 can be solid or hollow.

Slidably affixed to the mounting bar 37 is a split retaining ring generally designated by the numeral 40. At the upper end or collar 41 of the retaining ring 40, there is provided a mounting hole 42 of a size similar to the hole 36 provided in adapter 35. The fit between the mounting hole 42 and the mounting bar 37 should be such that the split retaining ring 40 can be easily slid up and down the length of the bar.

Referring to FIGS. 1, 7 and 8, it can be seen that between the faces of the collar 41, a recess 43 is provided into which a spring clamp 44 is positioned. The spring clamp 44 contacts the mounting beam 37 through the openings 44A. Provided at the extremities 45 of the spring clamp 44 are tabs 46 adapted to be squeezed by the operator to spread apart the spring clamp 44 to allow movement of the sliding or split retaining ring 40 anywhere on the mounting bar 37.

The sliding or split retaining ring 40 includes a semi-circular housing 47 with an inner semi-circular ring section 48 slidably mounted therein. A mounting portion 52 of inner semi-circular ring section 48 protrudes through the slot 53 in the fixed semi-circular housing 47. A handle 54 is mounted to the mounting portion 52. A spring 55 (FIG. 2) is interposed between the handle 54 and the mounting or boss portion 56 of fixed semi-circular housing 47 to keep the inner semi-circular ring section biased in a normally closed position. Other methods well known in the art may be used to accomplish this, and are well within the scope of the present invention.

Referring again to FIG. 2, there is shown a modification of the present invention having a single in-line node of power input for a low voltage application. In this modification, the power transfer means, generally designated by the numeral 20, is fixedly mounted to the bottom of the fixture mounting pole 21. The fixture mounting pole 21 is co-axial with the first axis of rotation 27 and the single node of power input indicated at 30 is co-axial with the first axis of rotation 27 and the second axis of rotation 28. Again, as in the previous example, the shaft 31 is co-axial with the second axis of rotation 28 but in this modification has a transverse opening 60 provided therein in which the mounting bar or beam 37 is mounted. The application of any type of force to any of the components which has a rotational component about the first axis of rotation 27 will cause rotation of the fixture mounting pole 21 about said the first axis of rotation. Any input of power which has a component about the second axis of rotation 28 will cause rotation of the shaft 21 and therefore of the mounting bar 37 about the second axis of rotation. Moving the handle 54 of the retaining ring 40 allows the adapter ring 64 to be inserted and removed from the retaining ring, while depressing the tabs 46 allows the entire split retaining ring to be moved along the mounting beam 37.

Figure 2:
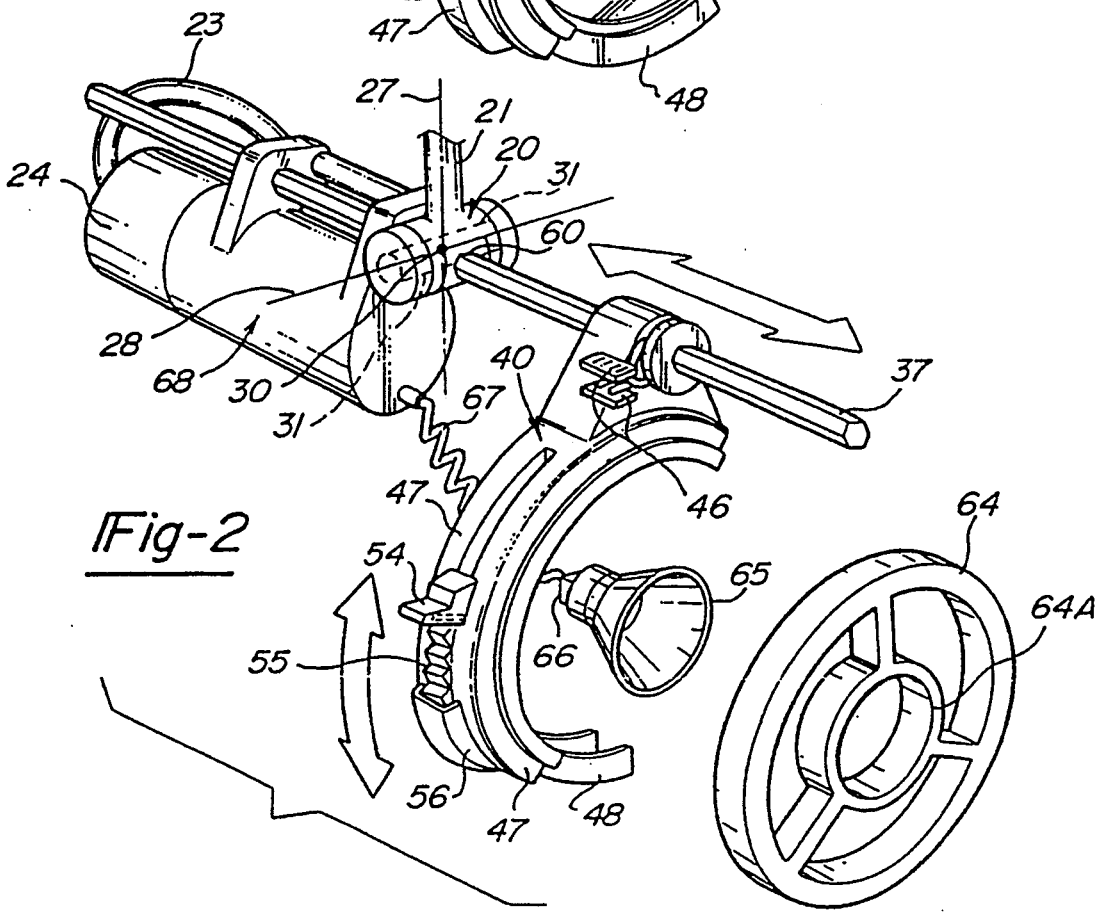
FIG. 2 is a perspective view of a modification of the present invention, wherein the mounting bar or rod is mounted to the lower end of a pendant or mounting pole for rotation about two axes of rotation through an in-line axis of power input; and wherein said retaining ring is shown having an adapter ring and a low voltage bulb connected to a power transformer mounted to said mounting rod or bar.

With further reference to FIG. 2, the split retaining ring 40 in this embodiment of the invention is adapted to hold adapter ring 64 having inner ring 64A adapted to hold a low voltage light source or means of illumination 65, which may be such as the MR16 lamp illustrated. In this embodiment of the invention, the lamp is plugged into connector 66 electrically connected to the end of coiled power cord 67, which is connected to one end of a low voltage transformer 68. Low voltage electrical transformer 68 has a socket 69 (FIG. 3) which screws into the standard lamp socket 24 connected by the power cord 23 to a source of line voltage.

Figure 3:
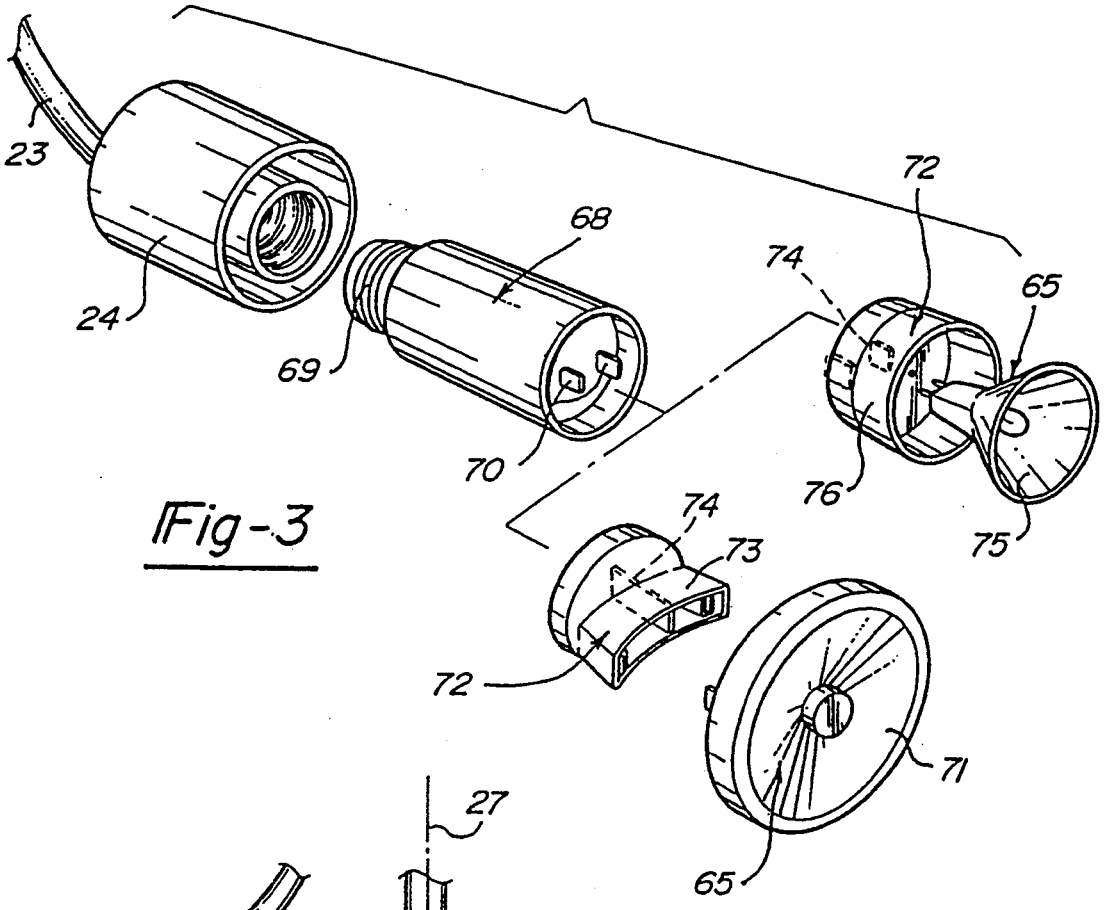
FIG. 3 is an exploded view of the low voltage transformer and lighting assembly shown in FIG. 2.

With reference to FIG. 3, it should be understood that many modifications of the invention are possible, depending on the particular illuminating requirements that are required. If male terminals or connectors 70 are provided at one end of the low voltage transformer 68 in place of the coiled power cord 67 illustrated in FIG. 2, several applications are accommodated. First, the light source or means of illumination 65 may be such as an AR111 lamp 71 connected to an adapter means 72, which may be such as an AR111 connector 73. The AR111 connector 73 has female receptacles 74 to establish electrical contact with the male terminals 70 of the low voltage transformer 68 to provide power to the AR111 lamp 71.

In another modification of the invention, the illumination means 65 takes the form of an MR16 lamp 75 connected through an MR16 connector 76 to the low voltage transformer 68. A portion of the great versatility of the present invention may now be understood. By the provision of the retaining ring 40, not only can any full or high voltage light source be used in connection with a source of line current coming through power cord 23 to socket 24, but a wide variety of low voltage applications may also be accommodated simply by positioning the adapter ring 64 in the retaining ring 40, and interposing the low voltage transformer 68 between the socket 24 and the source of illumination 65. It should be understood that the MR16 and AR111 lamps illustrated are just a few of the many low voltage lamps that can be used with the present invention. Virtually any low voltage lamp may be used simply by providing a different adapter ring 64. All of such uses are within the scope of the present invention.

Figure 4:
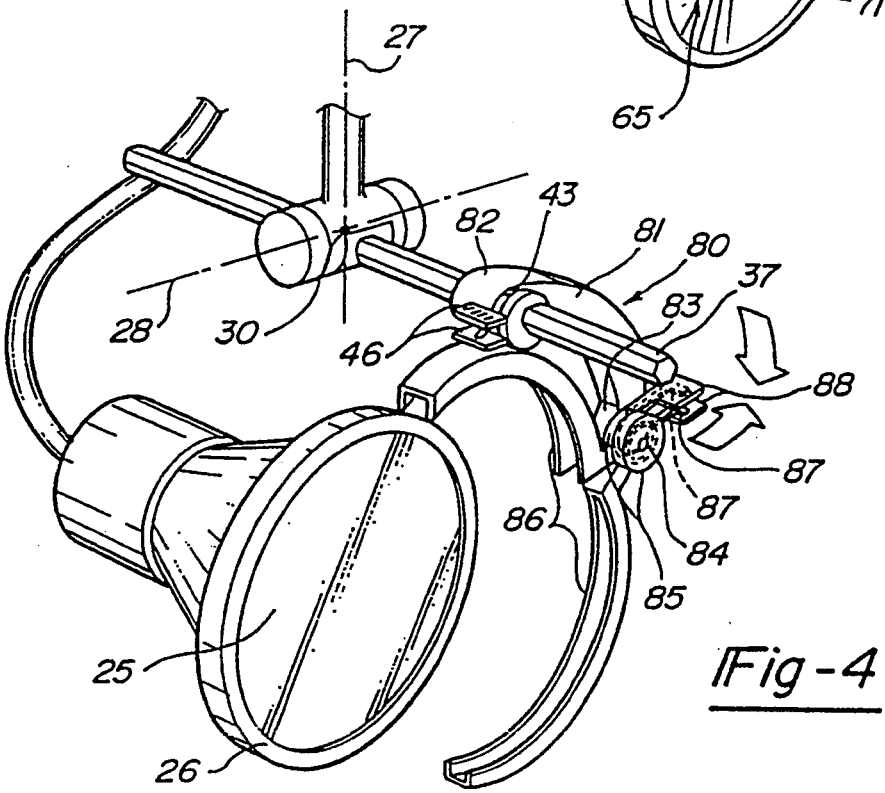
FIG. 4 is a view, similar in part to FIG. 1, but showing a caliper-type retaining ring.

To give the present system even greater versatility, instead of a split retaining ring 40, a caliper-type retaining ring 80 may be provided, either in the embodiment shown in FIG. 4 where the single node of power input is not offset, or in FIG. 5 where the single node of power input 30 is offset from the first axis of rotation 27. In the embodiment of the invention shown in FIG. 4, the recess 43 needed for the spring clamp 44 is now provided at the upper end or collar 82 of arm 81. The remainder of the construction of the movement means for the caliper-type retaining arm is identical to that shown in FIGS. 7 and 8 for the split retaining ring 40, and need not be described in detail. The caliper-type retaining arm 80 is moved along the mounting bar or beam 37 in the same manner as the split retaining ring 40.

The arm 81 generally is of a curvelinear construction forming a segment of a circle, and that segment may be as large as needed depending upon the particular application to which the caliper-type retaining ring is put. In the present invention, the arm 81 forms a segment substantially equal to a quarter circle, and has fixedly mounted in its lower end 83 a shaft 84.

Journalled for rotation about the shaft 84 are bearing portions 85 of identical segmental arms 86 having a substantially U-shaped cross section to accept the lamp 25.

It can be understood by those skilled in the art that a wide variety of cross-sections of the segmental arms 85 may be provided depending upon the application and the particular accessory which needs to be held by the arms.

Spring means 87 well known in the art acting upon the undersides of caliper tabs 88 act to keep the segmental arms in a normally closed position, retaining the luminaire 26 until pressure is applied thereto.

Referring now specifically to FIG. 5, it can be seen that the arm portion 81 of the caliper-type retaining ring 80 can be eliminated, and the segmental arms 86 can be provided directly below the mounting bar or beam 37. In this application, the two segmental arms are pinned together for rotation by pin 90, and spring means well known in the art (not shown) constitute biasing means to bias the segmental arms 86 to a normally closed position to hold the luminaire 26 in position. Although not readily apparent from FIG. 5, when the segmental arms 86 are biased to their normally closed position, slightly more than a semi-circle is formed so that the luminaire 26 may be retained. For convenience of the operator, a single caliper tab 91 is provided on one of the segmental arms 86. By applying pressure between the single caliper tab 91, and the upper of the tabs 46, an easy method is provided to spread the segmental arms 86 when needed.

For even greater versatility, it can be seen that a plurality of retaining rings and storage means may be used as illustrated in FIG. 6. A power transfer means 20 mounted at the lower end of the fixture mounting pole 21 is provided with a mounting beam 37. A pair of split retaining rings 40 are mounted to the mounting beam 37. In this illustration, the inner of the split retaining rings is a free fit and does not have the tabs 46 or the spring clamp 44 for movement. It essentially follows the movement of the outer retaining ring 40. It can be understood that one or both of the retaining means 39 could be in the form of the split retaining ring 40 or the caliper-type retaining ring 80. In this instance, one of the retaining rings is holding a luminaire 26 while the other is holding a light filtering means 93. It should be understood the term "light filtering means" should be interpreted in its broadest sense to include such things as polarizing filters, color filters, barn doors, and the like.

To provide even greater versatility to the present invention, a storage means 96 may be mounted to the integrated lighting system of the present invention on the rearwardly extending portion 95 of the mounting beam or bar 37. The storage means may be of many sizes and shapes depending on the accessories to be stored therein. In the illustrated storage means 96 there is essentially provided a cradle portion 98 having mounting portions 99 which have appropriate openings 100 to fit over the rearwardly extending portion 95 of the mounting bar 37. It should be understood that the storage means 96 can take an almost infinite variety of forms depending on the accessories to be stored. In this case, a plurality of filtering or light control means 93 are stored in the cradle portion 98.

Thus, by continuing to study the longstanding problems in the spotlight art, and addressing the needs of the art to have a spotlight which is adaptable to both high voltage and low voltage needs, and which provides a convenient means of storage for spotlight accessories, I have provided a novel integrated lighting system.

I claim:

1. A split retaining ring including:

(a) a semi-circular housing including a circumferentially extending slot and a boss;

(b) a semi-circular ring section slidably mounted to said semi-circular housing, including a mounting portion protruding through the slot in said semi-circular housing;

(c) a handle mounted to the mounting portion of said semi-circular ring section; and (d) a spring interposed between said handle and the boss of said semi-circular housing.

2. The retaining ring defined in claim 1, and further including:

(a) a collar provided on said semi-circular housing;

(b) a mounting hole provided in said collar;

(c) a recess provided in said collar; and (d) a spring clamp positioned in said recess.

3. The retaining ring defined in claim 2, and further including:

(a) tabs provided at the extremities of the spring clamp.

4. A caliper-type retaining ring, said caliper-type retaining ring including, in combination:

(a) an arm having an upper end and a lower end, the upper end of the arm having a mounting hole therein for mounting said caliper-type retaining ring to a mounting bar;

(b) a shaft fixedly mounted to the lower end of said arm; and (c) a pair of segmental arms rotatably mounted to said shaft.

5. The retaining ring described in claim 4, and further including:

(a) a recess provided in the upper end of said arm, said recess surrounding at least a portion of a mounting bar mounted in the mounting hole and providing an opening in communication with said mounting bar; and (b) a spring clamp mounted in the recess in said arm, (c) spring means biasing said segmental arms to a normally closed position.

6. The retaining ring defined in claim 5, and further including:

(a) caliper tabs mounted to said spring means to aid in operation of said spring means.

7. A caliper-type retaining ring, said caliper-type retaining ring including:

(a) a first segmental arm having a mounting hole therein for mounting said caliper-type retaining ring to a mounting bar;

(b) a second segmental arm rotatably connected to said first segmental arm by a pin separated and distinct from said mounting hole; and (c) spring means biassing said first and said second segmental arms to a normally closed position.

8. The caliper-type retaining ring defined in claim 7, wherein said first segmental arm further includes a recess surrounding at least a portion of said mounting hole and providing an opening in communication with a mounting bar mounted in said mounting hole.

9. The caliper-type retaining ring defined in claim 8, and further including:

(a) a spring clamp mounted in said recess.

10. The retaining ring defined in claim 9, wherein said segmental arms are of a "U" shaped cross-section.

11. The retaining ring defined in claim 10, and including:

(a) a caliper tab mounted on said second segmental arm.

* * * * *